US006260268B1

(12) United States Patent
Gentry

(10) Patent No.: US 6,260,268 B1
(45) Date of Patent: Jul. 17, 2001

(54) METHOD OF FORMING A SOLID COMPLIANT PIN CONNECTOR CONTACT

(75) Inventor: John T. Gentry, Springfield, MO (US)

(73) Assignee: Positronic Industries, Inc., Springfield, MO (US)

( * ) Notice: Subject to any disclaimer, the term of this patent is extended or adjusted under 35 U.S.C. 154(b) by 0 days.

(21) Appl. No.: 09/372,630

(22) Filed: Aug. 11, 1999

(51) Int. Cl.[7] ..... H01R 43/16

(52) U.S. Cl. ..... 29/874; 29/882; 29/884; 439/751; 439/823; 439/873

(58) Field of Search ..... 29/874, 882, 884, 29/832, 825; 439/751, 823, 873

(56) References Cited

U.S. PATENT DOCUMENTS

| | | | | |
|---|---|---|---|---|
| 1,671,540 | | 5/1928 | Monteil . | |
| 2,415,722 | | 2/1947 | Bauer . | |
| 3,031,641 | | 4/1962 | Camzi . | |
| 3,391,567 | | 7/1968 | Gregory | 72/367 |
| 3,545,080 | * | 12/1970 | Evans | 29/874 |
| 3,766,516 | | 10/1973 | Appleton . | |
| 3,784,965 | | 1/1974 | Murphy . | |
| 3,786,558 | | 1/1974 | McCarthy . | |
| 3,853,377 | | 12/1974 | Shlesinger, Jr. . | |
| 4,017,143 | | 4/1977 | Knowles . | |
| 4,296,549 | | 10/1981 | Bertoglio | 29/874 |
| 4,345,373 | | 8/1982 | Lacaze, Jr. | 29/874 |
| 4,373,262 | * | 2/1983 | Blakesley | 29/874 X |
| 4,374,607 | | 2/1983 | Bright et al. . | |
| 4,415,220 | | 11/1983 | Kant . | |
| 4,447,108 | * | 5/1984 | Ghigliotti et al. . | |
| 4,486,068 | | 12/1984 | Ghigliotti et al. . | |
| 4,526,429 | | 7/1985 | Kirkman . | |
| 4,586,778 | | 5/1986 | Walter et al. . | |
| 4,596,437 | | 6/1986 | Rush . | |
| 4,606,589 | | 8/1986 | Elsbree, Jr. et al. . | |
| 4,720,268 | | 1/1988 | Weiss . | |
| 4,740,166 | | 4/1988 | Barnhouse . | |
| 4,746,301 | | 5/1988 | Key | 439/82 |
| 4,759,721 | | 7/1988 | Moore et al. | 439/82 |
| 4,769,907 | | 9/1988 | Sebastien | 29/874 |
| 4,806,103 | | 2/1989 | Kniese et al. | 439/60 |
| 4,810,214 | | 3/1989 | Yohn | 439/842 |
| 4,834,662 | | 5/1989 | Schempp et al. | 439/83 |
| 4,857,018 | | 8/1989 | Pickles | 439/751 |
| 4,878,861 | | 11/1989 | Kendall et al. | 439/751 |
| 4,894,031 | | 1/1990 | Damon et al. | 439/885 |
| 4,906,209 | | 3/1990 | Tanabe et al. | 439/620 |
| 4,969,259 | | 11/1990 | Macek et al. | 29/845 |
| 5,035,659 | | 7/1991 | Peterson | 439/751 |
| 5,329,697 | | 7/1994 | Gentry | 29/874 |
| 5,374,204 | | 12/1994 | Foley et al. | 439/751 |
| 5,403,214 | | 4/1995 | Tirrell | 439/825 |
| 5,487,684 | | 1/1996 | Schalk et al. | 439/715 |
| 5,667,412 | | 9/1997 | Takahashi et al. | 439/751 |
| 5,772,450 | | 6/1998 | Bernardini | 439/67 |

* cited by examiner

*Primary Examiner*—Carl J. Arbes
(74) *Attorney, Agent, or Firm*—Senniger, Powers, Leavitt & Roedel

(57) ABSTRACT

A method of forming a solid compliant connector contact which permits the compliant portion to be formed rapidly and inexpensively. Cylindrical bar stock is turned to form the outer contour of the contact, including a contact portion having a diameter larger than an opening into which it will be inserted in use. The contact is made compliant by plunging a cutter having a circular blade rotating about a center of the blade into the contact portion and removing the circular blade from the contact portion to form the slot to have a generally arcuate shape corresponding to the shape of the circular blade. The contact portion is resiliently deformable upon insertion into the opening for exerting a radially outward force within the opening to hold the contact in electrical contact with the opening.

11 Claims, 4 Drawing Sheets

METHOD OF FORMING A SOLID COMPLIANT PIN CONNECTOR CONTACT

BACKGROUND OF THE INVENTION

This invention generally relates to solid compliant electrical connector contacts and more specifically to a method for forming a compliant portion of such contacts.

Compliant connector contacts are commonly used to achieve a secure mechanical and electrical connection when the contacts are plugged into openings, such as on a circuit board, without the need for soldering or other securing steps. An example of such a compliant connector contact is shown in my U.S. Pat. No. 5,329,697. Contacts of this type are frequently grouped together in an insulator body to form an electrical connector. Compliant connector contacts have compliant portions with lateral dimensions greater than the diameter of the hole into which they are to be inserted. These compliant portions are weakened, generally by removal of material, to permit elastic deformation of the contact in the compliant region. The act of inserting the contact into the hole causes portions of the contact to be resiliently deformed upon entering the hole, making the compliant portion small enough to fit into the hole. The outward bias of the deformed portions acts to hold the contact in the hole and to maintain good electrical contact without soldering or other secondary connections.

The type of connector contact to which the present invention generally relates is a solid connector contact, which is machined from solid cylindrical bar stock. Solid connector contacts have current carrying capacity and strength which are superior to contacts formed by stamping and rolling. Solid connector contacts permit greater flexibility in choice of material because they are machined. Thus, materials having better electrical properties may be used. However, machined connector contacts take longer to make and are more expensive than stamped connector contacts. The step of making the connector contacts with a compliant portion adds further time and manufacturing cost to the production of solid connector contacts.

SUMMARY OF THE INVENTION

Among the several objects and features of the present invention may be noted the provision of a method for forming a compliant connector contact which requires few manufacturing steps; the provision of such a method which can be carried out inexpensively; the provision of such a method which limits the number of cuts made in the connector contact; and the provision of such a method which is easy to carry out.

Generally, a compliant connector contact of the present invention is formed by turning generally cylindrical bar stock to have a contact end for insertion into an opening and another end opposite the contact end. The contact end has a guide portion and a contact portion, the contact portion having a larger radial dimension than the guide portion. A slot is formed in the contact portion of the contact end to a depth less than a full lateral dimension of the contact portion. The step of forming the slot comprises plunging a cutter having a circular blade rotating about a center of the blade into the contact portion and removing the circular blade from the contact portion to form the slot to have a generally arcuate shape corresponding to the shape of the circular blade. The contact portion is resiliently deformable upon insertion into the opening for exerting a radially outward force within the opening to hold the contact in electrical contact with the opening.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
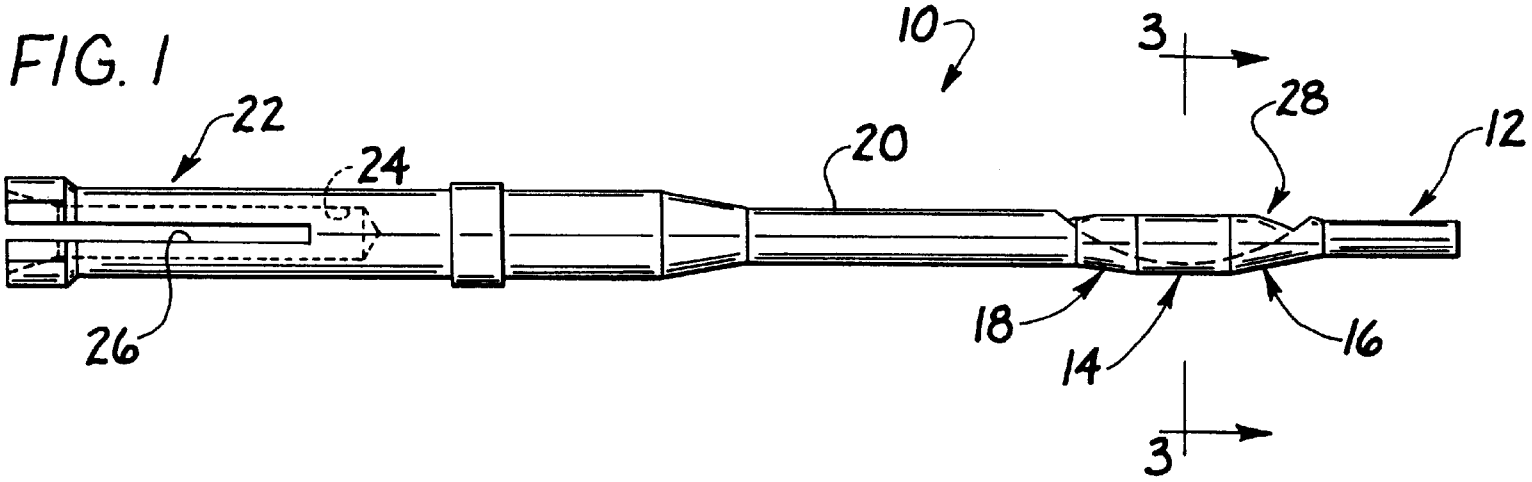
FIG. 1 is a side elevational view of a compliant connector contact made according to the present invention.

Referring now to the drawings and in particular to FIG. 1, a solid compliant connector contact 10 formed by the method of the present invention is shown to comprise a guide portion 12, a contact portion 14, a first tapered portion 16 and a second tapered portion 18, all located generally adjacent one end of the contact. The first tapered portion 16 is disposed between the guide portion 12 and the contact portion 14 to facilitate movement of the contact portion into a hole H in a circuit board CB (see FIG. 4). As described more fully below, the contact portion 14 and small parts of the tapered portions 16,18 are formed to be compliant for holding the contact in electrical contact with the circuit board in the hole. The second tapered portion 18 is on the opposite (left) side of the contact portion 14 from the first tapered portion 16 and transitions to a mid-section 20 of the connector contact 10 having a larger diameter than the guide portion 12 for greater current carrying capacity and mechanical strength. The end of the contact 10 opposite the guide portion 12 is formed in the illustrated embodiment as a female connection portion (generally indicated at 22) having an axial socket 24 and slits 26 on diametrically opposite sides of the contact extending into the socket.

Figure 3:
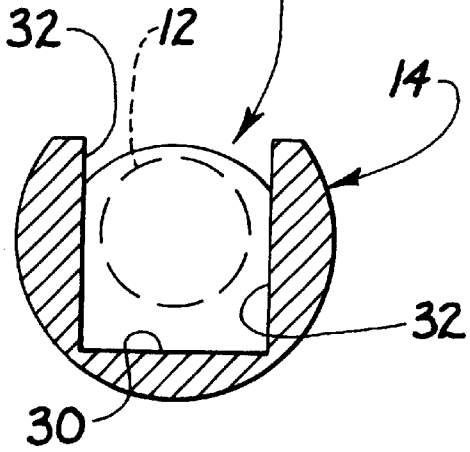
FIG. 3 is a section taken in the plane including line 3—3 of FIG. 1.
Figure 2:
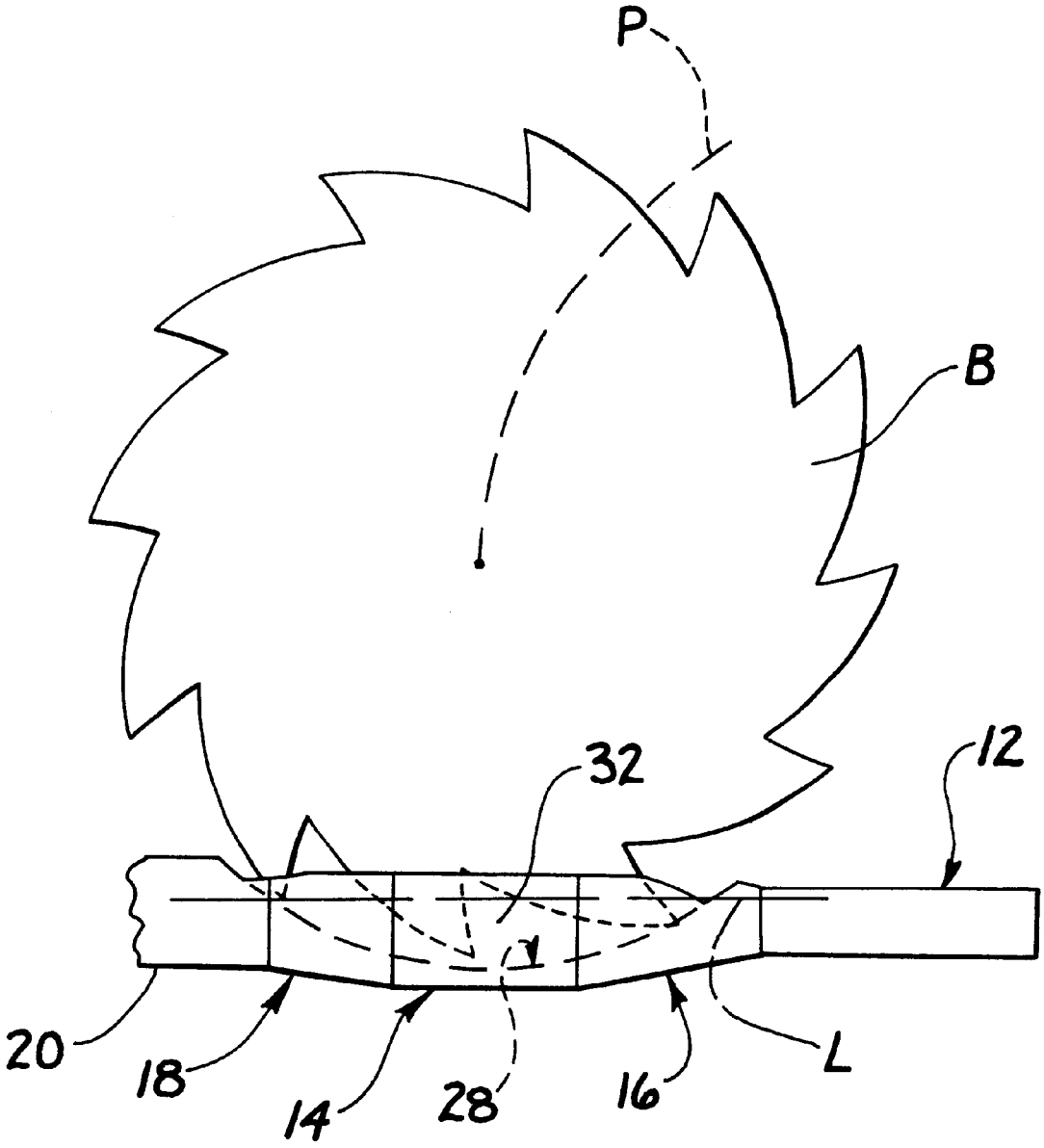
FIG. 2 is an enlarged, fragmentary side elevational view illustrating formation of a slot in a compliant portion of the contact.

Compliancy of the contact portion 14 is achieved by the presence of a single slot generally indicated at 28. The slot, as indicated by the hidden lines in FIGS. 1 and 2, is arcuate in shape and extends to a depth less than the lateral dimension of the connector contact 10. Therefore, the slot 28 does not extend all the way through the contact 10 at any location. However, it is to be understood that a slot could extend completely through a contact without departing from the scope of the present invention. The depth of the slot 28, because of its arcuate configuration and the shape of the connector contact 10, changes from end to end, being shallower in the tapered portions 16,18 and mid-section 20 and deepest in the contact portion 14. As shown in FIG. 3, the slot 28 has a generally rectangular cross section, including a floor 30 and side walls 32 extending up from the floor. As a result of the slot 28 being cut through portions of the circumferential connector contact 10 of different diameters, the upper (or "free") edges of the side walls 32 are parallel to the longitudinal axis of the contact in a mid-portion, but extend at an angle at each end. At the ends, the upper edges are skew with respect to the longitudinal axis of the connector contact. It is to be understood that "upper" edge as used herein is a convenient reference to the orientation of the pin as shown in FIGS. 1–3, but does not indicate an absolute orientation.

Figure 4:
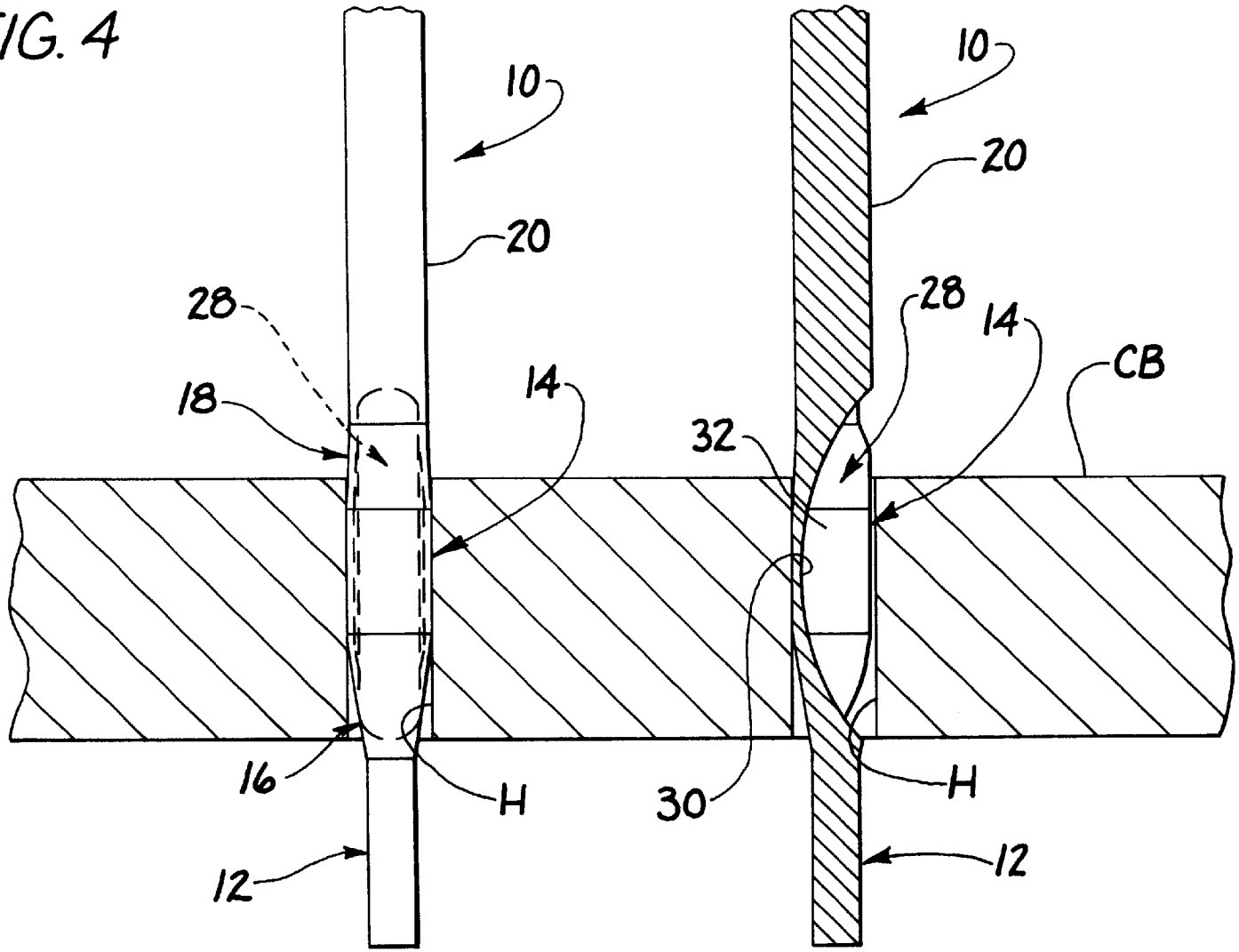
FIG. 4 is a fragmentary cross section of a circuit board and showing insertion of compliant connector contacts through holes in the circuit board.
Figure 5:
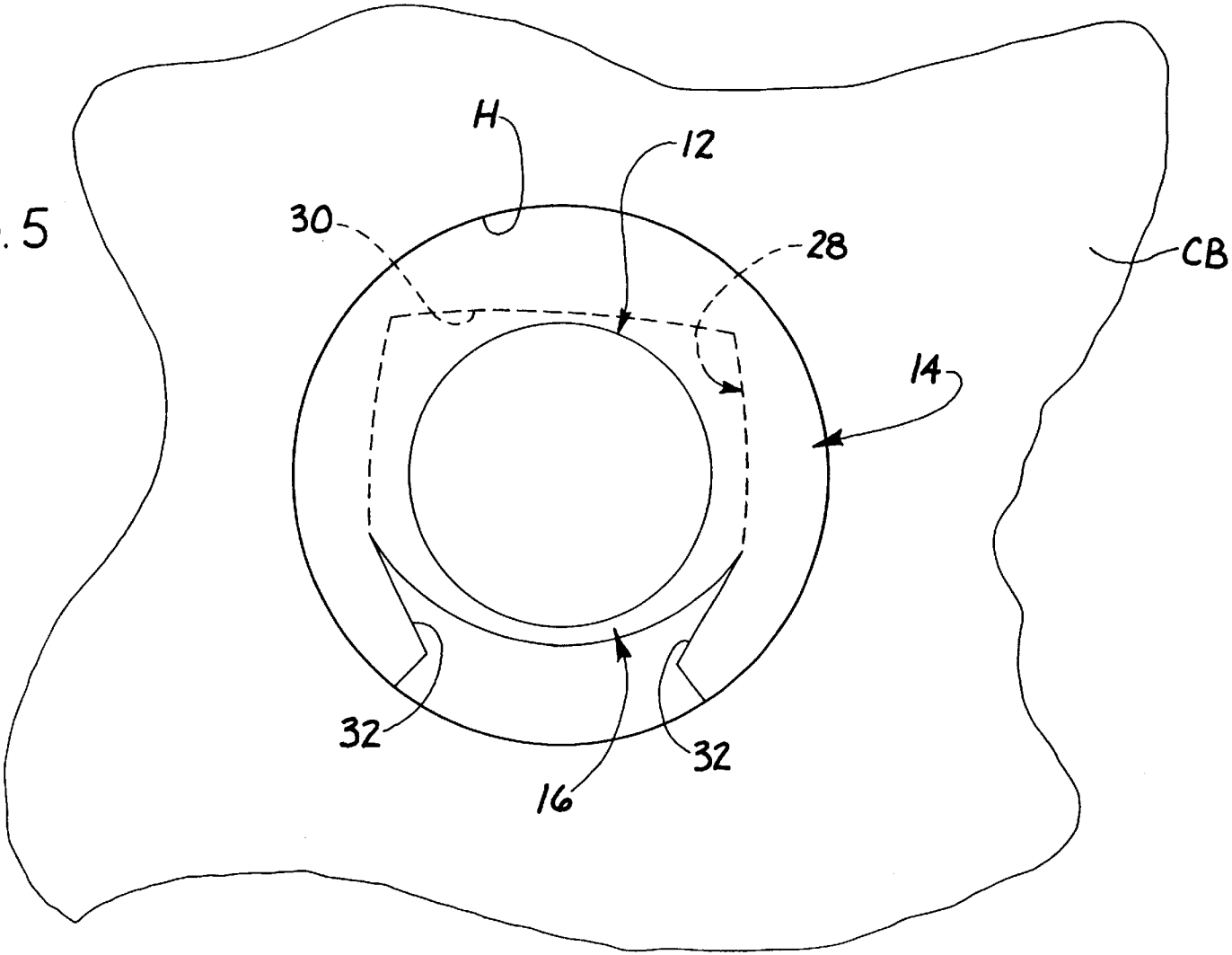
FIG. 5 is an enlarged, fragmentary right side view of the circuit board illustrating deformation of the compliant portion in the circuit board hole.

Referring now to FIG. 4, the thin guide portion 12 of the connector contact 10 facilitates starting the contact into a hole H in a circuit board CB. The first tapered portion 16 guides the contact portion 14 into the hole H as the connector contact 10 continues to be inserted. The contact portion 14 has a diameter which is larger than the diameter of the circuit board hole H. The transition provided by the first tapered portion 16 allows the larger contact portion 14 to be wedged into the hole. In order to be received in the hole, the contact portion 14 must be deformed. Deformation occurs by bending of the upper part of each side wall 32 of the slot 28 generally about a line L (FIG. 2) extending parallel to the longitudinal axis of the connector contact 10 and intersecting the ends of the upper edge of the side wall. The configuration of the connector contact 10 as deformed is shown in FIG. 5. As seen in cross section, the shape of the contact portion 14 roughly assumes the shape of the Greek letter omega in its deformed configuration. The material of the connector contact 10 is sufficiently elastic so that when deformed the deflected portions of the sidewalls 32 bear against the wall of the hole H, holding the contact in the hole and maintaining good electrical contact with the circuit board CB within the hole.

The compliant connector contact 10 of the present invention is formed from generally cylindrical bar stock (not shown) which is bored axially to form the socket 24. The 25 contact 10 is then turned on a screw machine (not shown) to produce the outer contour of the contact, including the guide portion 12, tapered portions 16,18, contact portion 14 and mid-section 20. In this condition, the contact portion 14, tapered portions 16,18 and mid-section 20 have shapes symmetrical about the longitudinal axis of the connector contact. The contact portion 14 is generally cylindrical and the tapered portions 16,18 are generally in the shape of a frustum of a cone. The axial slits 26 are cut through the contact 10 in the female connection portion 22. The end of the contact opposite the compliant portion 14 may be formed other than with a female connection without departing from the scope of the present invention. It is known for contacts to be formed with male connections or other types of connections, and such connections may be used in the present invention.

The connector contact 10 is made compliant by a quick and easy manufacturing step. A key cutter having a circular blade B is plunged into the contact portion 14 (and simultaneously into the adjacent tapered portions 16,18 and mid-section 20) and then withdrawn to form the slot 28. The movement of the center of the blade B during formation of the slot is along a smooth path P. The path is illustrated as a curve, but could also be a straight line. The blade B is preferably not moved along the length of the connector contact 10 as the slot 28 is formed, but always includes at least a component of motion in a direction perpendicular to the longitudinal axis of the contact. Thus, the slot 28 of the preferred embodiment is formed by a rapid in and out movement of the blade B. As a result, the shape of the slot 28 corresponds to the shape of the blade B used to cut it. As stated above, the slot 28 is curved along its lengthwise extent, and has a generally rectangular cross section. However, it is envisioned that a slot (corresponding to slot 28 of the preferred embodiment) could be formed by plunging the blade B and then moving the blade parallel to the longitudinal axis of the contact 10 without departing from the scope of the present invention. In that event, the shape of the slot 28 would not conform exactly to the shape of the blade B.

The upper edges of the side walls 32 of the slot 28 are milled down to prevent them from hanging up on the circuit board CB at the periphery of the hole H when inserted. It is generally unnecessary to mill the side walls when the diameter of the compliant portion 14 of the contact 10 exceeds about 1.5 mm. At or below a compliant portion diameter of 1.5 mm, the amount to be milled off varies in accordance with the diameter. For example, a contact having a compliant portion 14 measuring about 1.2 nm in diameter, about 0.24 mm would preferably be milled from the upper edges of the side walls 32.

In view of the above, it will be seen that the several objects of the invention are achieved and other advantageous results attained. A compliant connector contact is formed from cylindrical bar stock with quick and easy manufacturing steps. The connector contact is made compliant by a single plunge of a circular saw to form a slot which does not pass completely through the contact The speed of formation of the finished contact and the manufacturing expense are markedly reduced.

As various changes could be made in the above constructions without departing from the scope of the invention, it is intended that all matter contained in the above description or shown in the accompanying drawings shall be interpreted as illustrative and not in a limiting sense.

What is claimed is:

1. A method of forming a complaint connector contact receivable in an opening comprising the steps of:

turning generally cylindrical bar stock to have a contact end for insertion into the opening and another end opposite the contact end, the contact end having a guide portion and a contact portion, the contact portion having a larger radial dimension than the guide portion;

forming a slot in the contact portion of the contact end, said step of forming the slot comprising plunging a cutter having a circular blade rotating about a center of the blade into the contact portion and removing the circular blade from the contact portion to form the slot, said step of plunging being carried out only one time for each contact, the contact portion being resiliently deformable upon insertion into the opening for exerting a radially outward force within the opening to hold the contact in electrical contact with the opening.

2. A method as set forth in claim 1 wherein the step of plunging the circular blade of the cutter comprises moving the blade into the contact and removing the blade therefrom along a smooth path.

3. A method as set forth in claim 2 wherein the movement of the blade along the path always includes at least a component of motion in a direction perpendicular to a longitudinal axis of the contact.

4. A method as set forth in claim 3 wherein the step of forming the slot comprises forming the slot to have a generally arcuate shape corresponding to the shape of the circular blade of the cutter.

5. A method as set forth in claim 4 wherein the slot formed has a generally rectangular cross section including a floor and side walls extending up from the floor.

6. A method as set forth in claim 1 wherein the step of turning cylindrical stock includes forming a first tapered portion connecting the guide portion to the contact portion and a second tapered portion connecting the contact portion to a narrower portion on the opposite end of the contact portion from the first tapered portion.

7. A method as set forth in claim 6 wherein the step of forming the slot comprises forming the slot to extend into the tapered portions such that an upper edge of each side wall of the slot includes portions adjacent ends of the side wall skewed to the longitudinal axis of the contact, each side wall being adapted to deform about a line extending generally parallel to the longitudinal axis of the contact and intersecting at least one end of the side wall.

8. A method as set forth in claim 1 wherein said step of plunging the cutter includes plunging the cutter to a depth less than a fill lateral dimension of the contact.

9. A method as set forth in claim 1 further comprising the step of cutting back free edges of the slot.

10. A method as set forth in claim 1 further comprising the step of arranging the circular blade and cylindrical bar stock to each other such that the slot formed in said step of forming a slot is parallel to a longitudinal axis of the cylindrical bar stock.

11. A method as set forth in claim 1 further comprising the step of holding the cylindrical bar stock stationary during said step of plunging the cutter.

* * * * *